US005330061A

United States Patent [19]

Geltz

[11] Patent Number: 5,330,061

[45] Date of Patent: Jul. 19, 1994

[54] SPINNING SHOWER ROD MECHANISM

[75] Inventor: Charles E. Geltz, Drexel Hill, Pa.

[73] Assignee: Zenith Products Corporation, Aston, Pa.

[21] Appl. No.: 32,616

[22] Filed: Mar. 17, 1993

[51] Int. Cl.[5] ..... A47H 1/08

[52] U.S. Cl. ..... 211/105.4; 248/200.1; 248/265

[58] Field of Search ..... 248/200.1, 261, 262, 248/264, 265, 270; 160/330, 350; 211/105.4

[56] References Cited

U.S. PATENT DOCUMENTS

| | | | |
|---|---|---|---|
| 670,585 | 3/1901 | Fowler . | |
| 704,403 | 7/1902 | Thill . | |
| 856,316 | 6/1907 | Thurston . | |
| 1,256,849 | 2/1918 | Vaudreuil . | |
| 1,548,053 | 8/1925 | Mead | 248/200.1 |
| 1,639,551 | 8/1927 | Booth | 248/200.1 X |
| 1,681,010 | 8/1928 | Raggio . | |
| 2,532,909 | 12/1950 | Hart | 248/200.1 X |
| 2,713,983 | 7/1955 | Kay . | |
| 2,919,134 | 12/1959 | Zuro | 211/103.4 |
| 2,974,806 | 3/1961 | Seewack | 211/105.4 X |
| 3,333,808 | 8/1967 | DuBoff . | |
| 3,521,758 | 7/1970 | Guilfoyle, Sr. . | |
| 3,920,220 | 11/1975 | Elias | 254/98 |
| 3,946,978 | 3/1976 | Evans | 248/264 |
| 5,056,753 | 10/1991 | Lunau et al. | 248/542 |

*Primary Examiner*—Ramon O. Ramirez
*Attorney, Agent, or Firm*—Ratner & Prestia

[57] ABSTRACT

A telescoping rod assembly which can be secured between two supports has a first hollow tube having first and second ends with a second hollow tube, also having first and second ends, fitted within the first hollow tube. One end of the second hollow tube is used for bracing against one of the supports. A flexible threaded rod is fitted within the second hollow tube, with one end of the flexible threaded rod used for bracing against the other support. Threading means are secured to the second hollow tube for extendable threading the flexible threaded rod in the first hollow tube. The first hollow tube is secured to the end of the flexible threaded rod which is braced against one of the supports.

15 Claims, 4 Drawing Sheets

SPINNING SHOWER ROD MECHANISM

FIELD OF THE INVENTION

The present invention relates to telescoping rods which can be secured between two support pieces and more specifically to a shower curtain rod for securing between two walls of a shower.

BACKGROUND OF THE INVENTION

In order to mount a shower curtain for a shower, it is necessary to first secure a shower curtain rod between two of the walls which define the shower area. In some cases, the shower curtain rod can be a fixed length tube permanently mounted between the walls. The problem with a design of this type, is that the fixed length rod must be cut exactly to the dimensions of the shower space. The rod is then fitted into a pair of rod mounts with each mount secured to a wall. Should it be necessary to adjust the height of the shower rod, it would be necessary to revise the rod mounts, repair the wall where the fixed rod was mounted, and secure the mounts to the new location. It may also be necessary to cut a new fixed length rod, if the dimensions of the walls vary between the old and new positions.

Adjustable, pressure fitted shower rods solve the problems associated with a fixed length rod. In such a shower rod, the length of the shower rod is adjustable within a range. Tightening the rod in the space between the two walls maintains a tight fix, sufficient to securely hold a shower curtain without slipping. These designs require a large number of rotations of the threaded rods to extend the rods to the typical four to six foot wall spans.

Same designs, such as those shown in U.S. Pat. No. 670,585 to Fouler, U.S. Pat. No. 856,316 to Thirston and U.S. Pat. No. 1,548,053 to Mead use a combination of a threaded rod fitted within another threaded rod and a biasing spring to maintain tension as the rod is extended to fit between walls.

Other designs such as those shown in U.S. Pat. No. 2,919,134 to Zero, U.S. Pat. No. 3,521,758 to Gylfoyle and U.S. Pat. No. 704,403 to Phil show threaded rods which do not use a biasing spring to maintain force.

The designs using a spring, aside from having the additional manufacturing cost and added complexity of having a spring component, suffer from the difficulty of having to provide sufficient force to compress this spring when adjusting the rod. Further, there is always the possibility of the rod and spring becoming entangled or the spring popping out of the rod during assembly/-disassembly.

In the designs which do not use a spring, the threaded fittings must be sufficiently tight to maintain enough force to keep the rod in place. In these designs, it is possible for the threads to loosen, with the rod slipping or falling. With the light weight materials typically used in the manufacture of shower curtain rods (and curtain rods) some form of biasing mechanism is desirable to maintain a tight fit and prevent slippage of the rod.

SUMMARY OF THE INVENTION

A telescoping rod assembly which can be secured between two walls in accordance with the present invention, comprises a first hollow tube with a second hollow tube fitted within the first hollow tube. A flexible threaded rod is fitted within the second hollow tube, with one end of the flexible fitted rod having a pad for providing a pressure fit against a wall. The second hollow tube is fitted with a nut at one end, with threading corresponding to the threading of the flexible threaded rod. At the other end of the second hollow tube is a pressure pad for making a pressure fit against the other wall when the shower rod assembly is extended to its desired length. The first hollow tube is secured to the pressure pad of the flexible threaded rod to allow for a substantially continuous outside diameter with the second hollow tube.

The telescoping rod assembly of the present invention has a thread size which allows easy extension by turning the rod assembly on end so that the inner, hollow tube can spiral towards the ground. The inner spiral tube spirals to the ground due to gravity, allowing ease of set-up to the desired length.

BRIEF DESCRIPTION OF THE FIGURES

The invention will now be described by way of non-limiting examples, with reference to the attached drawings in which.

DETAILED DESCRIPTION

Figure 1:
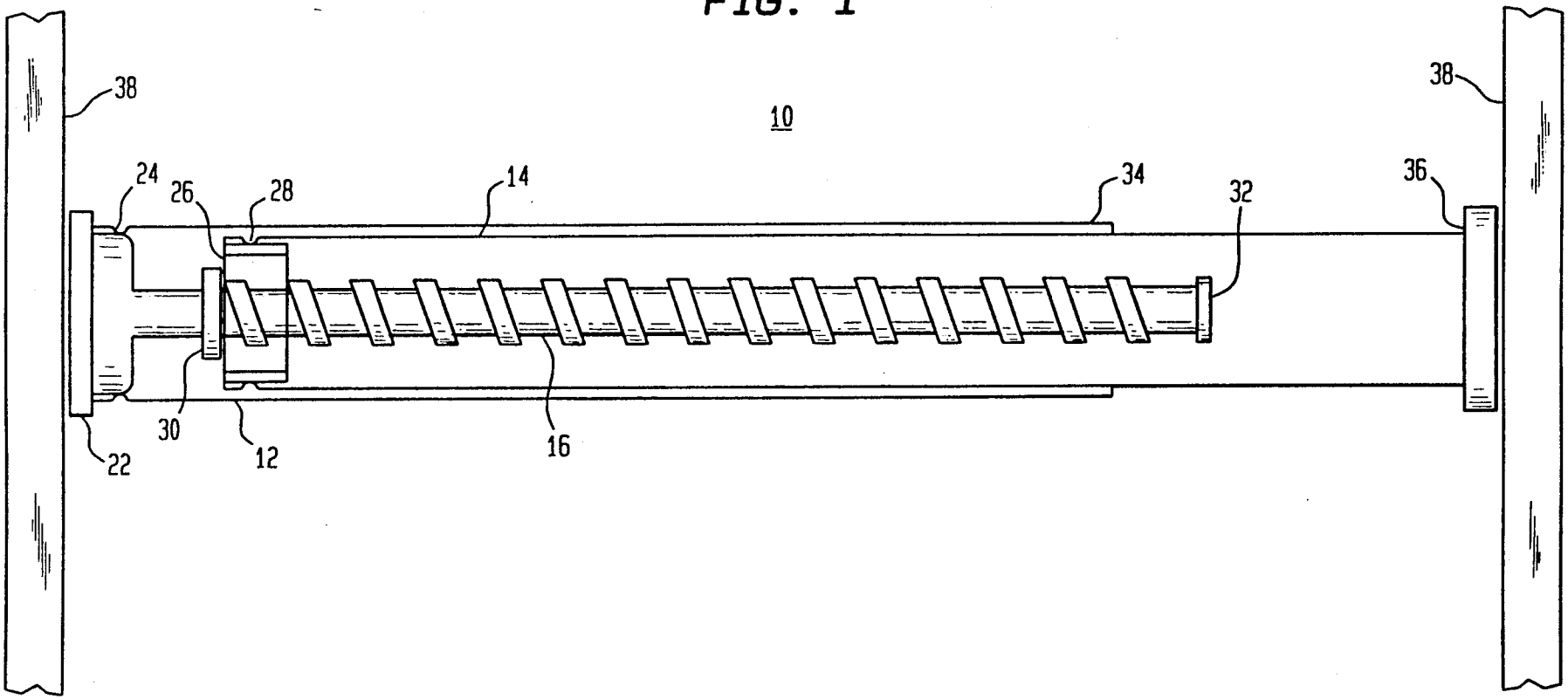
FIG. 1 is a sectional view of an exemplary a embodiment of the present invention.
Figure 2:
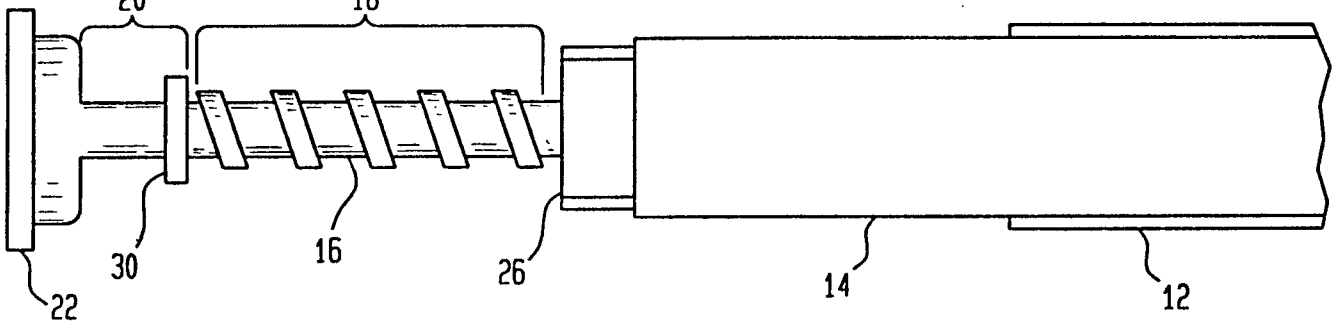
FIG. 2 is an exploded perspective view of one end of an exemplary embodiment of the present invention.

There is shown in FIGS. 1 and 2 a telescoping rod assembly 10 which can be secured between two supports, such as walls 38. Telescoping rod assembly 10 can be used as a shower curtain rod, or as a standard curtain rod. Telescoping rod assembly 10 can also be used in a vertical position, between a floor and ceiling instead of walls 38. Such a vertical use could be as a support for hanging item. These uses are exemplary of those to which the present invention can be applied.

Telescoping rod assembly 10 is comprised of a first hollow tube 12. Shower curtain rods typically have an outer diameter of 1 inch. Accordingly, hollow tube 12 can have an outer diameter of 1 inch or other diameter as suited for the particular use to which it is being applied.

Fitted within hollow tube 12 is a second hollow tube 14. To provide a reasonably tight fit between the first hollow tube 12 and second hollow tube 14, hollow tube 14 may have an outside diameter of $\frac{7}{8}$ of an inch. This diameter provides a substantial continuity between the first hollow tube and the second hollow tube when the telescoping rod assembly 10 is extended to its desired length. This allows curtain rings (not shown) to slide easily over rod assembly 10.

The tube sizes provided are exemplary and do not serve as a limitation of the present invention.

Fitted within hollow tube 14 is a flexible threaded rod 16. Flexible threaded rod 16 is shown to have a threaded portion 18 and an unthreaded portion 20 in this exemplary embodiment of the present invention.

Flexible threaded rod 16 is fitted at one end with a pad 22 which is used to provide a secure pressure contact with wall 38.

Flexible threaded rod 16 has a thread size of between three and five threads per inch, with four threads per inch being that of the exemplary embodiment. Flexible threaded rod 16 is a 5/16 inch diameter shaft which is fitted with the threads. Again, the diameters specified are exemplary and not limiting of the present invention.

The thread size is important to the present invention, as it allows the "free spinning" of flexible threaded rod 16 when telescoping rod assembly 10 is being first extended to approximately the required distance between walls 38. Conversely, it also allows for easy retraction of the rod 10, should this be necessary. This free spinning design allows greater ease in setting-up the telescoping rod assembly as at four threads per inch, it would take approximately one hundred and four turns to telescope the tubes to a sixty inch overall length. Additional turns would be required to extend the rod to a seventy-two inch length. The final length depends on the spacing of the walls. By allowing flexible threaded rod 16 to spin freely, gravity assisted, the user is spared the time and possible muscle cramping effects of having to manually twist the rod to extend it to the desired length.

Flexible thread rod 16 is fitted with a stop piece such as stop pieces 30 and 32 to define the limits to which telescoping rod assemble 10 can be extended or collapsed. In the embodiment shown in FIG. 1, stop piece 30 is secured to an unthreaded portion of flexible threaded rod 16.

A nut 26 having a corresponding thread pattern to that of flexible thread rod 16 is secured to hollow tube 14 with a dimple connection 28. Methods, other than dimple connection for securing nut 26 to hollow tube 14, such as adhesives and welds, as well as others will be understood by those skilled in the art. Nut 26 is positioned at substantially the end of hollow tube 14 in the exemplarily embodiment of the present invention. Nut 26 can be positioned at other locations on hollow tube 14, so long as these locations allow extension of telescoping rod assemble 10 to the desired length.

It is also possible to have hollow tube 14 internally threaded, so that a nut 26 is not necessary.

Hollow tubes 12 and 14 may be made of a plastic or a metal material.

Figure 5:
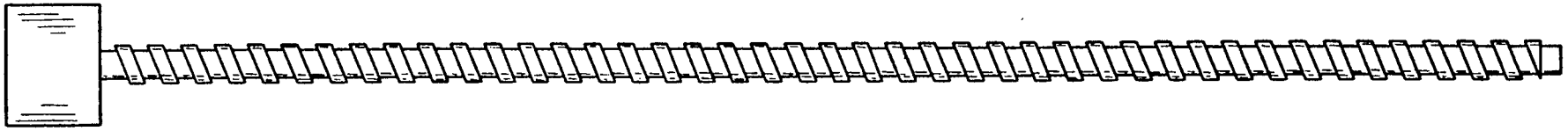
FIG. 5 shows a fully threaded rod used in an additional embodiment of the present invention.
Figure 3:
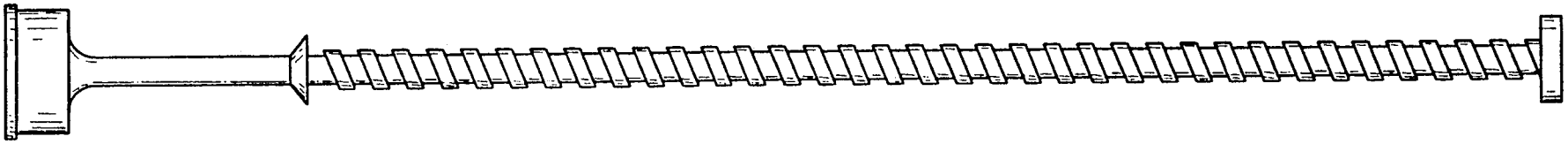
FIG. 3 shows a partially threaded flexible rod used in an exemplary embodiment of the present invention.
Figure 4B:
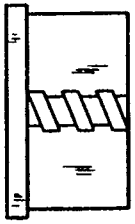
FIGS. 4A and 4B show views of a threaded nut for engaging a flexible rod of an exemplary embodiment of the present invention.
Figure 4A:
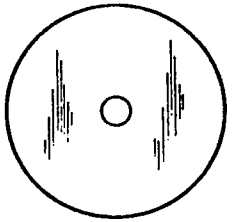

As shown in FIG. 5 a flexible rod 16 is threaded its entire length. A flexible threaded rod 16 as shown in FIG. 5 would be used in an additional embodiment of the present invention. A flexible threaded rod 16 is shown in FIG. 5 may or may not have a stop piece 30, but should have a stop piece 32, unless it is desired to completely disassembly the telescoping rod assemble in which it is being used.

Figure 6:
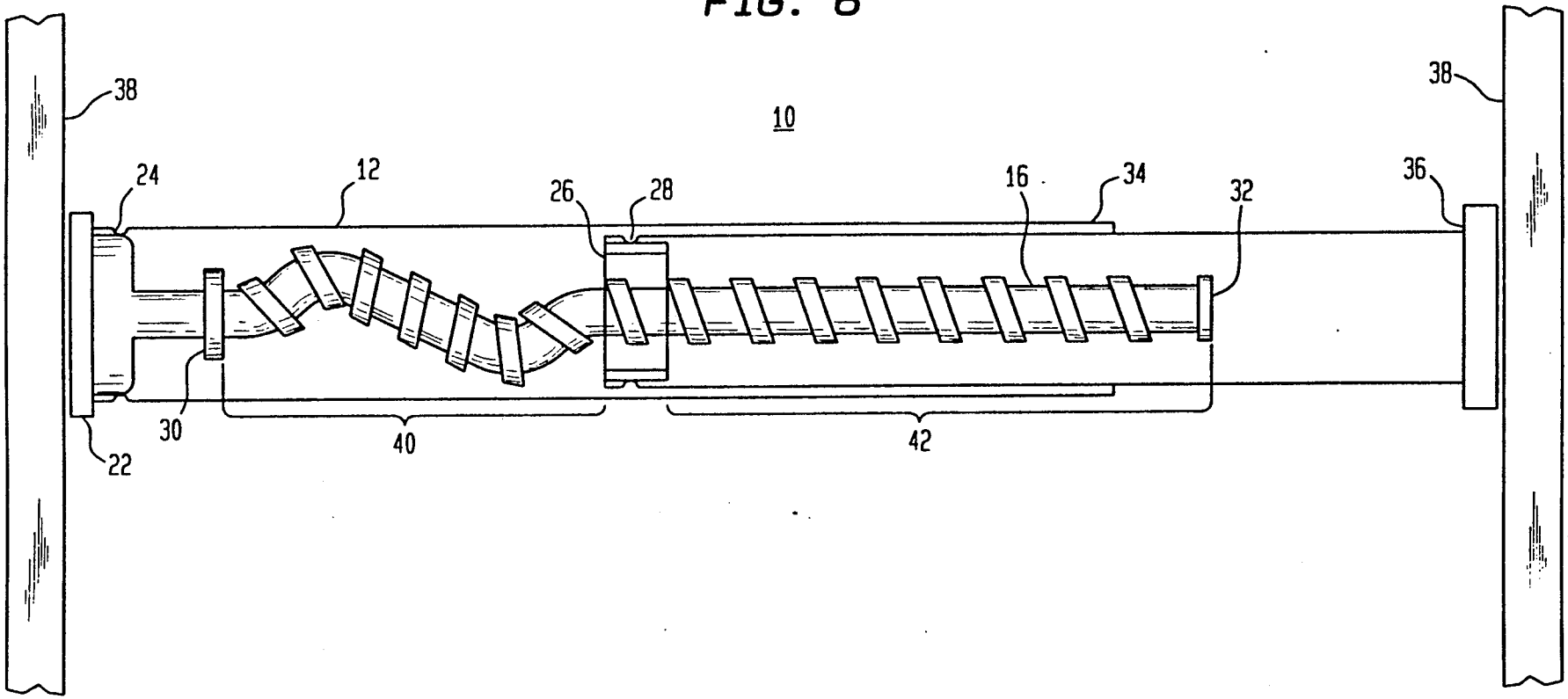
FIG. 6 is a perspective view of an exemplary embodiment of the present invention showing a flexible threaded rod which is flexed.

In FIG. 6 a cross sectional view of the present invention is shown in which flexible threaded rod 16 is flexed inside hollow tube 14 to provide sufficient tension to maintain a secure fit between supports such as walls 38. Flexible threaded rod 16 can be viewed as having two portions, a flexed portion 40 and an unflexed portion 42. The length of either portion depends upon the span between which rod 10 is fitted; the larger the span, the greater the length of flexed portion 40.

Flexible threaded rod 16 becomes flexed by screwing nut 26 along flexible threaded rod 16 while rod 10 is positioned between two walls 38. When flexible threaded rod 16 is flexed, force is exerted against walls 38. Force is also exerted between the threads of nut 26 and the threads of flexible threaded rod 16 to maintain the position of nut 26 along flexible threaded rod 16.

The present invention has been described in terms of exemplary embodiments. It is contemplated, however, that it may be practiced with modifications, some of which are outlined above, within the scope of the appended claims.

What is claimed:

1. A telescoping rod assembly which can be secured between two supports comprising:

a first hollow tube having first and second ends;

a second hollow tube having first and second ends fitted within said first hollow tube, said first end for bracing against one of said supports;

a flexible threaded rod having first and second ends fitted within said second hollow tube, said first end for bracing against the other of said supports;

threading means secured to said second hollow tube for extendably threading said flexible threaded rod in said first hollow tube; and securing means for securing said first end of said first hollow tube substantially close to said first end of said flexible threaded rod.

2. The telescoping rod assembly of claim 1 wherein said flexible threaded rod is comprised of a plastic.

3. The telescoping rod assembly of claim 2 wherein said flexible threaded rod is threaded between 3 and 5 threads per inch.

4. The telescoping rod assembly of claim 3 wherein said flexible threaded rod is flexed following full extension between said two supports.

5. The telescoping rod assembly of claim 1 wherein said threading means comprises a nut secured to said second hollow tube.

6. The telescoping rod assembly of claim 5 wherein said nut is secured to said second hollow tube with a dimple connection.

7. The telescoping rod assembly of claim 6 wherein said flexible threaded rod comprises:

a threaded portion extending from said second end of said flexible threaded rod;

an unthreaded portion extending from said first end of said flexible threaded rod; and a stop piece attached to said unthreaded portion of said flexible threaded rod substantially near to said threaded portion.

8. The telescoping rod assembly of claim 7 further comprising a stop piece attached at substantially said second end of said flexible threaded rod.

9. The telescoping rod assembly of claim 1 wherein said first end of said flexible threaded rod comprises means for maintaining a secure pressure fit to said other of said supports.

10. The telescoping rod assembly of claim 9 wherein said first end of said second hollow tube comprises means for maintaining a secure pressure fit to said one of said supports.

11. The telescoping rod assembly of claim 1 wherein said securing means comprises a dimple connection.

12. The telescoping rod assembly of claim 1 wherein said rod assembly can span a distance of between 40 and 72 inches.

13. A telescoping shower curtain rod assembly which can be securably mounted between two walls comprising:

a first hollow tube having first and second ends;

a second hollow tube having first and second ends fitted within said first hollow tube, said first end for bracing against one of said walls;

a threaded flexible rod having first and second ends fitted within said second hollow tube, said first end for bracing against the other of said walls comprising:

a threaded portion extending from said second end of said flexible threaded rod, an unthreaded portion extending from said first end of said flexible threaded rod, a first stop piece attached to said unthreaded portion of said flexible threaded rod substantially near to said threaded portion, and a second stop piece attached at substantially said second end of said flexible threaded rod;

a nut secured to said second hollow tube for extendable threading said flexible threaded rod in said first hollow tube said between said first and second stop pieces; and securing means for securing said first end of said first hollow tube substantially close to said first end of said flexible threaded rod.

14. The shower curtain rod assembly of claim 13 wherein said flexible threaded rod is threaded between 3 and 5 threads per inch.

15. The shower curtain rod assembly of claim 13 wherein said shower curtain rod assembly can span a distance between 40 and 72 inches.

* * * * *